US006062960A

United States Patent [19]

Kai et al.

[11] Patent Number: 6,062,960

[45] Date of Patent: May 16, 2000

[54] ORBITAL TOOL

[75] Inventors: Nobuto Kai; Masatoshi Fukinuki, both of Fucho, Japan; John E. Nemazi, Bloomfield Hills; Jeremy J. Curcuri, Southfield, both of Mich.

[73] Assignee: Ryobi North America, Inc., Anderson, S.C.

[21] Appl. No.: 09/067,108

[22] Filed: Apr. 27, 1998

[51] Int. Cl.[7] ..... B24B 23/00

[52] U.S. Cl. ..... 451/357; 451/358

[58] Field of Search ..... 451/357, 358, 451/359, 524, 557

[56] References Cited

U.S. PATENT DOCUMENTS

| | | | |
|---|---|---|---|
| Re. 33,335 | 9/1990 | Gentischer . | |
| 2,621,433 | 12/1952 | Boyle . | |
| 3,364,625 | 1/1968 | Sogge . | |
| 3,448,476 | 6/1969 | Zaccone | 451/359 X |
| 3,874,125 | 4/1975 | Stroezel . | |
| 3,943,669 | 3/1976 | Stroezel | 451/357 |
| 4,592,170 | 6/1986 | Hutchins et al. | 451/357 |
| 4,671,020 | 6/1987 | Hutchins . | |
| 4,729,194 | 3/1988 | Maier et al. . | |
| 4,744,177 | 5/1988 | Braun et al. . | |
| 4,854,085 | 8/1989 | Huber | 451/357 |
| 4,920,702 | 5/1990 | Kloss et al. . | |
| 5,123,216 | 6/1992 | Kloss et al. . | |
| 5,167,095 | 12/1992 | Berger . | |
| 5,206,967 | 5/1993 | Fushiya et al. | 451/357 X |
| 5,261,190 | 11/1993 | Berger et al. | 451/357 |
| 5,349,786 | 9/1994 | Dorrah . | |
| 5,357,715 | 10/1994 | Hiramatsu . | |
| 5,392,568 | 2/1995 | Howard, Jr. . | |
| 5,496,207 | 3/1996 | Hornung et al. | 451/357 |
| 5,888,128 | 3/1999 | Lamprecht et al. . | |

FOREIGN PATENT DOCUMENTS

| | | | |
|---|---|---|---|
| 505713 | 9/1954 | Canada | 451/357 |
| 3805926A1 | 9/1988 | Germany . | |
| 4118392A1 | 12/1992 | Germany . | |
| 1407628 | 9/1975 | United Kingdom | 451/357 |

*Primary Examiner*—David A. Scherbel
*Assistant Examiner*—Anthony Ojini
*Attorney, Agent, or Firm*—Brook & Kushman P.C.

[57] ABSTRACT

An orbital tool includes a housing, a motor, and an eccentric drive member rotatably driven by the motor shaft. A working member has an input portion engaging an output portion of the eccentric drive member. An annular pivot control member includes an annular central hub cooperating with the working member, an annular flange attached to the housing, and a web extending between the flange and the central hub. The pivot control member controls pivotal movement of the working member relative to the housing. The web enables the working member input portion to orbit about the drive axis as the eccentric drive member is rotated by the motor shaft.

16 Claims, 8 Drawing Sheets

Fig. 19
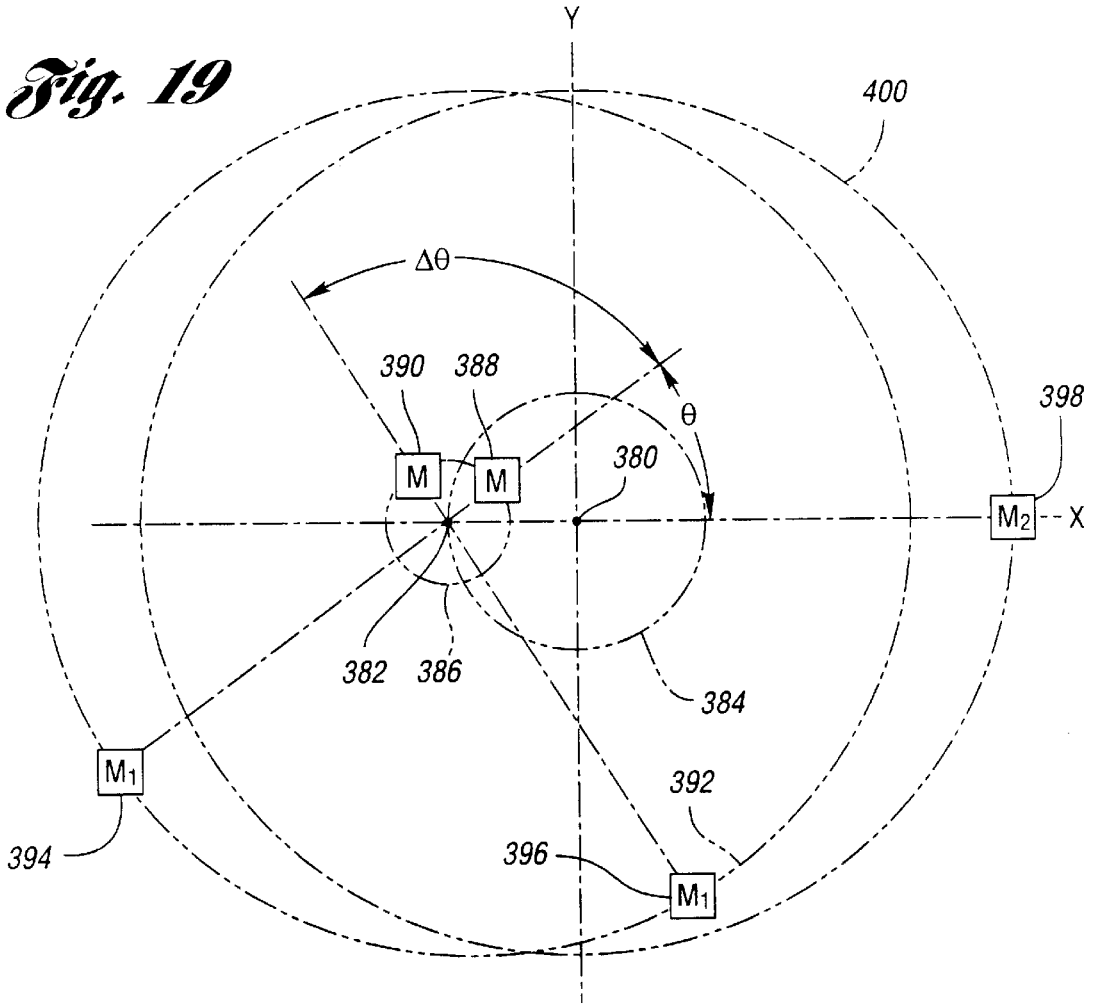
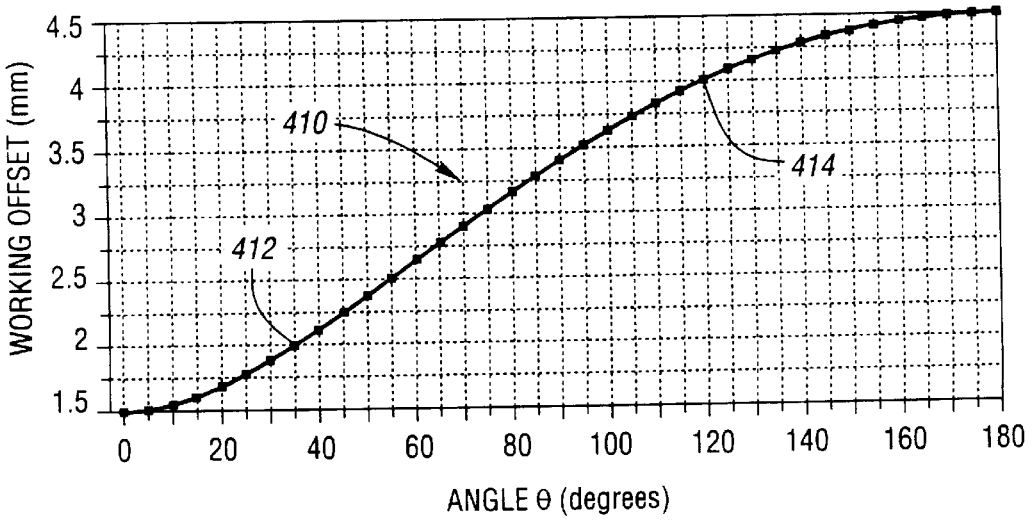
Fig. 20

ORBITAL TOOL

CROSS-REFERENCE TO RELATED APPLICATION

This application relates to co-pending U.S. patent application Ser. No. 09/067109, filed on the same day as this application, naming Mac Fukinuki, John Nemazi, and Jeremy Curcuri as inventors, entitled "Adjustable Eccentricity Orbital Tool", and having attorney docket number RMP 0577 PUS, which is hereby incorporated by reference in its entirety.

TECHNICAL FIELD

This application relates to orbital tools and to center pivot mechanisms for use in orbital tools.

BACKGROUND ART

The use of orbital tools has become widespread. For example, detail sanders having orbital sanding heads are used for performing specific finishing tasks such as sanding edges adjacent internal walls. To perform such tasks, the tools utilized must have controlled finite movement in a confined area so as to fine sand the desired area without damaging the surface upon which the work is being performed. Various approaches have been taken to perform the difficult task of sanding these internal corners and other hard to reach areas which require fine sanding or abrasion. Further, there are other applications for orbital tools, such as rough wood working sanders and auto body sanders.

Orbital tools utilize center pivot mechanisms to orbit or vibrate the working member of the tool. Some of these orbital tools, such as detail sanders, employ constrained pivoting mechanisms which prevent the working member of the orbital tool from freely rotating relative to the housing. Others of these orbital tools, such as rough wood working and auto body sanders, employ random pivoting mechanisms which permit the working member to freely rotate relative to the housing.

One example of an orbital tool is described in U.S. Pat. No. 4,744,177 issued to Braun et al. The Braun et al. patent describes an orbital tool with a center pivot mechanism that changes the eccentricity of the working member axis, or the working offset, by reversing motor direction to rotate an intermediate member 180 degrees relative to the drive shaft about a drive shaft eccentric axis. The 180 degree rotation moves the working member axis to a different working offset on the other side of the drive shaft central axis.

A disadvantage associated with existing orbital tools is the fact that dust, dirt, and other debris often find their way into the center pivot mechanism, causing poor performance and premature wear. Another disadvantage is that existing pivot mechanisms do not allow a single orbital tool to have a variety of different working members, in addition to adjustable eccentricity. Yet another disadvantage associated with existing orbital tools, including those with adjustable eccentricity mechanisms, is that a high moment of inertia about the eccentric axis due to the intermediate and working members causes excessive component loading and wear, particularly during motor reversing.

SUMMARY OF THE INVENTION

It is an object of the present invention to provide an orbital tool having an improved center pivot mechanism.

It is another object of the present invention to provide an improved orbital tool in which the working member may be selected from a plurality of working members to provide different types of working member pivotal movement as desired, such as constrained pivoting, controlled pivoting or random pivoting.

It is a further object of the present invention to provide an improved adjustable eccentricity orbital tool in which the center pivot mechanism is adjustable to vary the working member offset from the drive axis, while having a reduced moment of inertia about the eccentric axis due to the intermediate and working members to reduce component loading and wear.

In carrying out the above objects and other objects and features of the present invention, an orbital tool is provided. The orbital tool comprises a motor oriented within a housing, and an eccentric drive member pivotally supported relative to the housing and rotatably driven by a motor shaft. The motor shaft rotatably drives the eccentric drive member about a drive axis; and, the eccentric drive member has an output portion aligned along an eccentric axis. The eccentric axis is generally parallel to and radially offset from the drive axis.

A working member has an input portion, a mating surface, and a working surface. The working surface is perpendicular to the drive axis and extends radially outboard of the input portion. The working member input portion engages the output portion of the eccentric drive member, and is aligned along the eccentric axis to orbit about the drive axis as the drive member is rotated by the motor shaft.

An annular pivot control member has an annular central hub, an annular flange, and a web extending between the flange and the central hub. The central hub has a mating surface cooperating with the working member mating surface. The annular flange engages the housing at a location spaced from the central hub. The central hub mating surface and working member mating surface cooperate to control pivotal movement of the working member relative to the housing. The web enables the working member input portion to orbit about the drive axis as the eccentric drive member is rotated by the motor shaft.

In one embodiment, the central hub mating surface is affixed to the working member mating surface, and the flange is attached to the housing. The web prevents the working member from freely rotating relative to the housing, while elastically deforming sufficiently to enable the working member input portion to orbit the drive axis as the eccentric drive member is rotated by the motor shaft.

Further in carrying out the present invention, an orbital tool having a housing, motor, eccentric drive member, pivot control member, and a working member selected from a plurality of working members is provided. A first working member of the plurality of working members has a mating surface configured to mate with the central hub mating surface. The mating surfaces substantially prevent pivotal movement of the first working member relative to the housing as the eccentric drive member is rotated by the motor shaft. A second working member of the plurality of working members has a smooth surface positioned against the central hub mating surface. The smooth surface has a sufficiently low coefficient of friction to allow pivotal movement of the second working member relative to the housing.

Preferably, the central hub mating surface is defined by a gear with circumferentially spaced teeth. A third working member has a mating surface defined by a gear having circumferentially spaced teeth about a larger circumference than a central hub gear circumference. The central hub gear teeth engage the third working member gear teeth to provide controlled rotation of the third working member relative to the housing, as the eccentric drive member is rotated by the motor shaft.

Still further in carrying out the present invention, an orbital tool having a housing, motor, eccentric drive member, intermediate drive member, and working member, is provided. The intermediate drive member is pivotally supported relative to the eccentric drive member. The intermediate drive member has an output portion aligned along a working axis generally parallel to and radially offset from the eccentric axis. A working offset is defined between the working axis and the drive axis. The intermediate drive member is selectively rotatable about the eccentric drive member to vary the working offset to provide an adjustable eccentricity orbital tool.

A first balance mass is positioned to rotate together with the intermediate drive member about the eccentric axis. The first balance mass is selected and positioned based in part on a first distance defined between the eccentric and working axes to substantially minimize the moments of mass about the eccentric axis due to the working member. A second balance mass is positioned to rotate together with the eccentric drive member about the drive axis. The second balance mass is selected and positioned based in part on a second distance defined between the drive and eccentric axes to substantially minimize the moments of mass about the drive axis due to the first balance mass and the working member. The first distance is less than the second distance to reduce the moment of inertia about the eccentric axis due to the first balance mass and the working member.

The advantages accruing to the present invention are numerous, for example, the working member may be configured to cooperate with the central hub such that rotation of the working member is either prevented, controlled, or permitted, as desired, in addition to the orbital tool having multiple eccentricity settings which are all balanced and have a reduced moment of inertia about the eccentric axis to reduce component loading.

The above objects and other objects, features, and advantages of the present invention will be readily appreciated by one or ordinary skill in the art from the following detailed description of the best mode for carrying out the invention when taken in connection with the accompanying drawings.

BRIEF DESCRIPTION OF THE DRAWINGS

FIG. 19 is a diagram illustrating first and second balance masses selected and positioned in accordance with the present invention; and FIG. 20 is a graph depicting working offset versus intermediate drive member angular position, in an exemplary embodiment of the present invention.

BEST MODE FOR CARRYING OUT THE INVENTION

Figures 1, 2, 3:
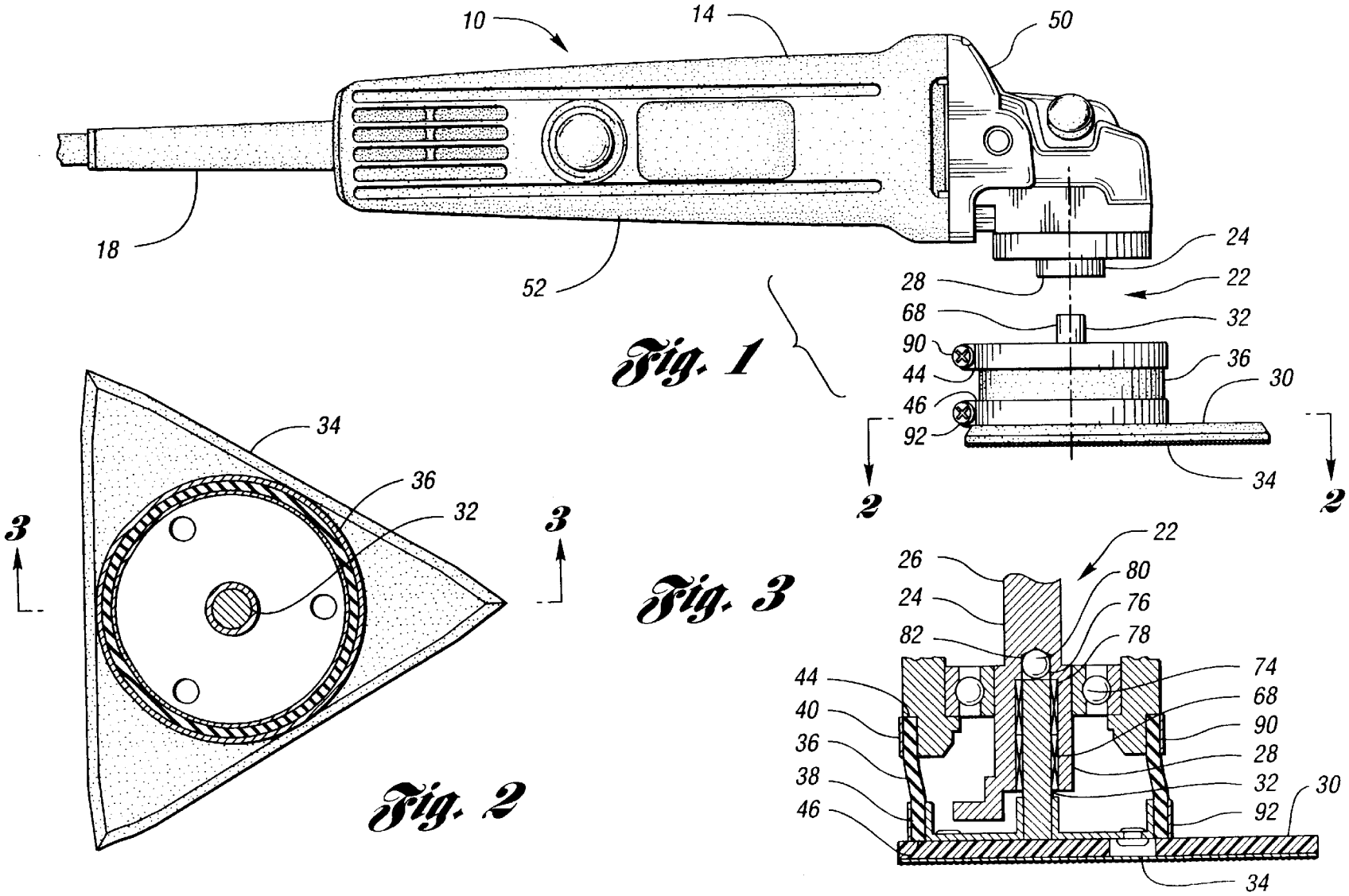
FIG. 1 is a side view of an orbital tool made in accordance with the present invention.
FIG. 2 is a cross-sectional view showing the pivot control member and the working member, taken along line 2—2 of FIG. 1.
FIG. 3 is an enlarged cross-sectional view of the center pivot mechanism of the orbital tool, taken along line 3—3 of FIG. 2.
Figure 4:
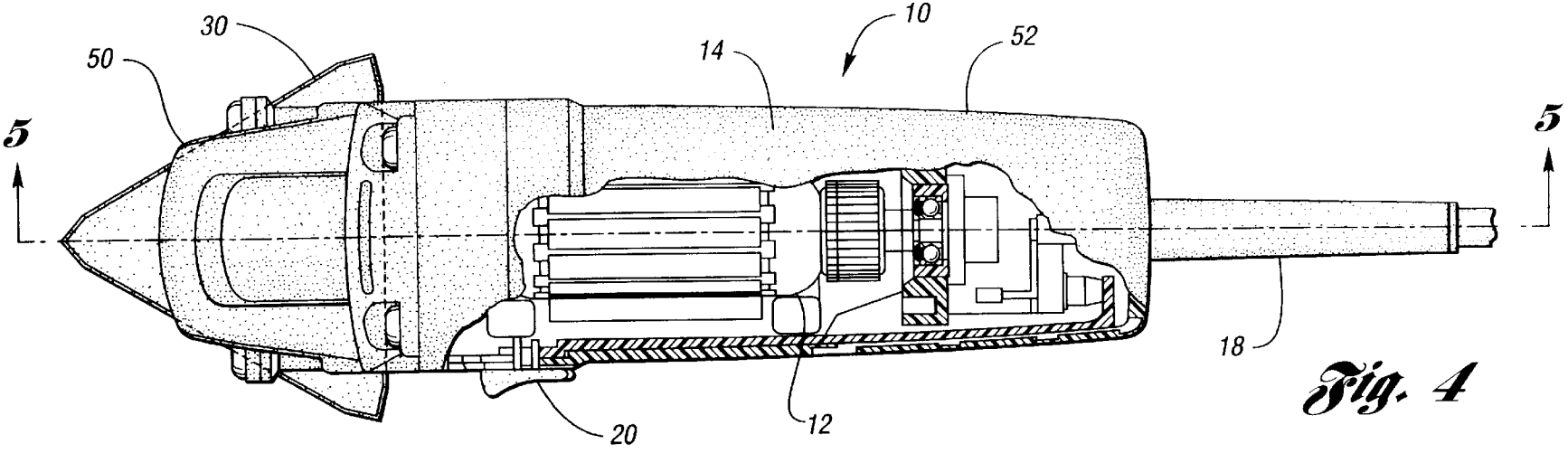
FIG. 4 is a top view, partially in section, of the orbital tool of FIG. 1.

Referring now to FIGS. 1–5, primarily to FIG. 1, a detail sander made in accordance with the present invention is generally indicated at 10. The detail sander 10 includes a motor 12 oriented within a housing 14. The motor 12 is operable to drive a rotatable motor drive shaft 16. The detail sander 10 has a power cord 18 for connection to a conventional AC power source. Alternatively, the detail sander 10 may be battery powered. Power is selectively supplied to the motor 12 by pressing switch 20. It is to be appreciated that there are many other orbital tool applications in accordance with the present invention, in addition to detail sanders, and that the detail sander 10 is shown as one example of such orbital tools.

The detail sander 10 further includes an eccentric drive member 24 pivotally supported relative to the housing. Eccentric drive member 24 has an output portion 28. A working member 30 has a central input portion 32 for pivotally engaging the output portion 28 of the eccentric drive member 24. The working member 30 also includes a working surface 34 for engaging a workpiece (not shown).

An annular pivot control member 36 has an annular central hub 38 with a mating surface extending about and affixed to the working member 30, at a working member mating surface. The pivot control member 36 also has an annular flange 40 engaging the housing 14, spaced apart from the central hub 38. As illustrated, flange 40 is affixed to housing 14; however, there are alternatives available.

Figure 5:
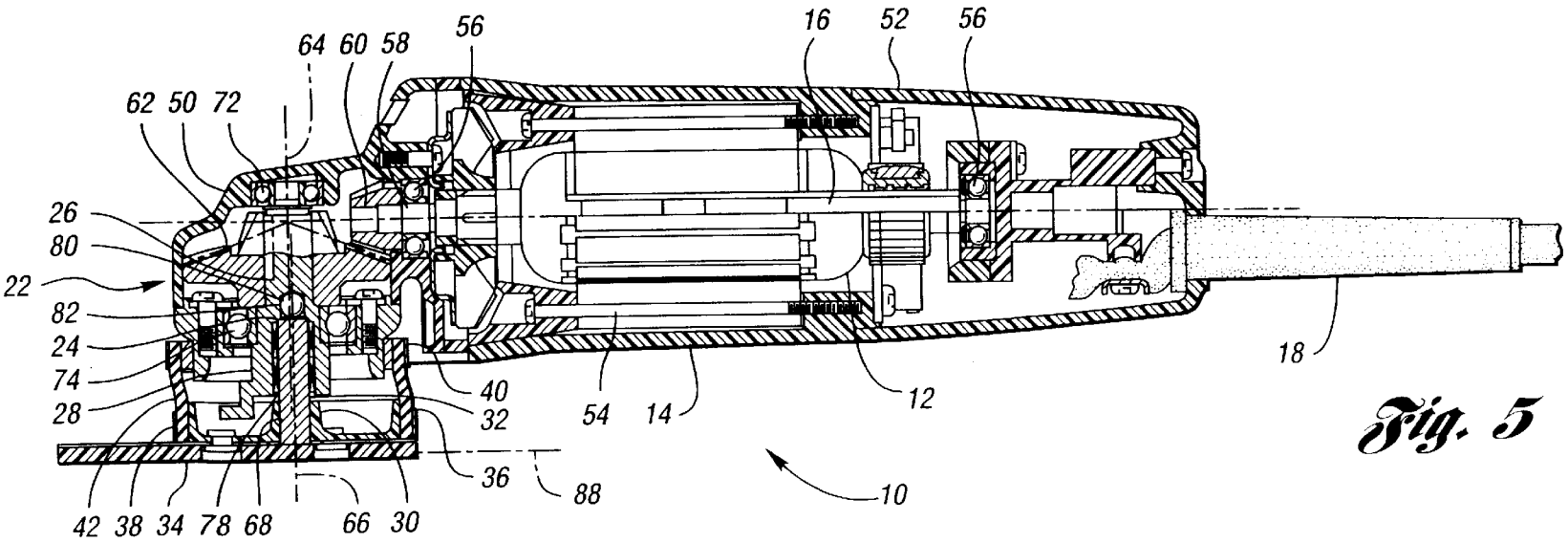
FIG. 5 is a cross-sectional view of the orbital tool, taken along line 5—5 of FIG. 4.

With continuing reference to FIGS. 1–5, primarily to FIG. 5, the detail sander 10 and center pivot mechanism 22 will be described in detail. The housing 14 includes a head portion 50 and a body portion 52. Motor 12 is received in the body portion 52, and secured by a pair of screw pins 54. The motor shaft 16 is supported by a pair of bearings 56. A drive end 58 of the motor shaft 16 has a gear 60 secured thereto.

The eccentric drive member 24 includes a gear 62 which cooperates with motor driven gear 60. The gear 62 is rotatably driven by motor shaft 16 about a drive axis 64. The output portion 28 is driven by gear 62, and is aligned along an eccentric axis 66. The eccentric axis 66 is generally parallel to and radially offset from the drive axis 64. In the embodiment illustrated in FIGS. 1–5, cylindrical shaft 68 of working member input portion 32 is supported at the eccentric drive member input and output portions 26 and 28, respectively, by a pair of bearings 72 and 74, respectively.

Working member input portion 32 is aligned along the eccentric axis 66. Working member input portion 32 pivotally engages the output portion 28 of the eccentric drive member 24. In the embodiment illustrated in FIGS. 1–5, the output portion 28 of the eccentric drive member 24 defines a cylindrical cavity 76. Cylindrical shaft 68 is sized to be received in the cylindrical cavity 76. Preferably, bearings 78 are received in cylindrical cavity 76 along the cavity interior walls; and, another bearing 80 is positioned in the cylindrical cavity 76 for pivotally engaging an end 82 of the cylindrical input shaft 68. The working surface 34 of working member 30 is perpendicular to the drive axis and extends radially outboard of the working member input portion 32.

Web 42 of pivot control member 36 extends circumferentially about the drive axis 64 and the eccentric axis 66. The web 42 extends between the flange 40 and the central hub 38. Preferably, the web 42 is formed of elastic material, and as one continuous piece which substantially shields the output portion 28 of the eccentric drive member 24 and the working member input portion 32. The center pivot mechanism 22 is shielded by the web 42 from debris such as dust, dirt, and other work area contaminates that the detail sander may encounter.

In the embodiment shown in FIGS. 1–5, the web 42 prevents the working member 30 from freely rotating relative to the housing 14, while elastically deforming sufficiently to enable the working member input portion 32 to orbit about the drive axis 64 as the eccentric drive member 24 is rotated by the motor shaft 16. Preferably, the pivot control member 36 is generally cylindrical and aligned parallel to the drive axis 64. One axial end 44 of the pivot control member 36 forms the flange 40. The other axial end 46 of the pivot control member 36 forms the central hub 38.

As best shown in FIGS. 1 and 3, pivot control member 36 is held in place by first and second annular clamps 90 and 92, respectively. First annular clamp 90 secures annular flange 40 to the housing 14. Second clamp 92 secures central hub 38 to the working member 30.

Figures 6, 7:
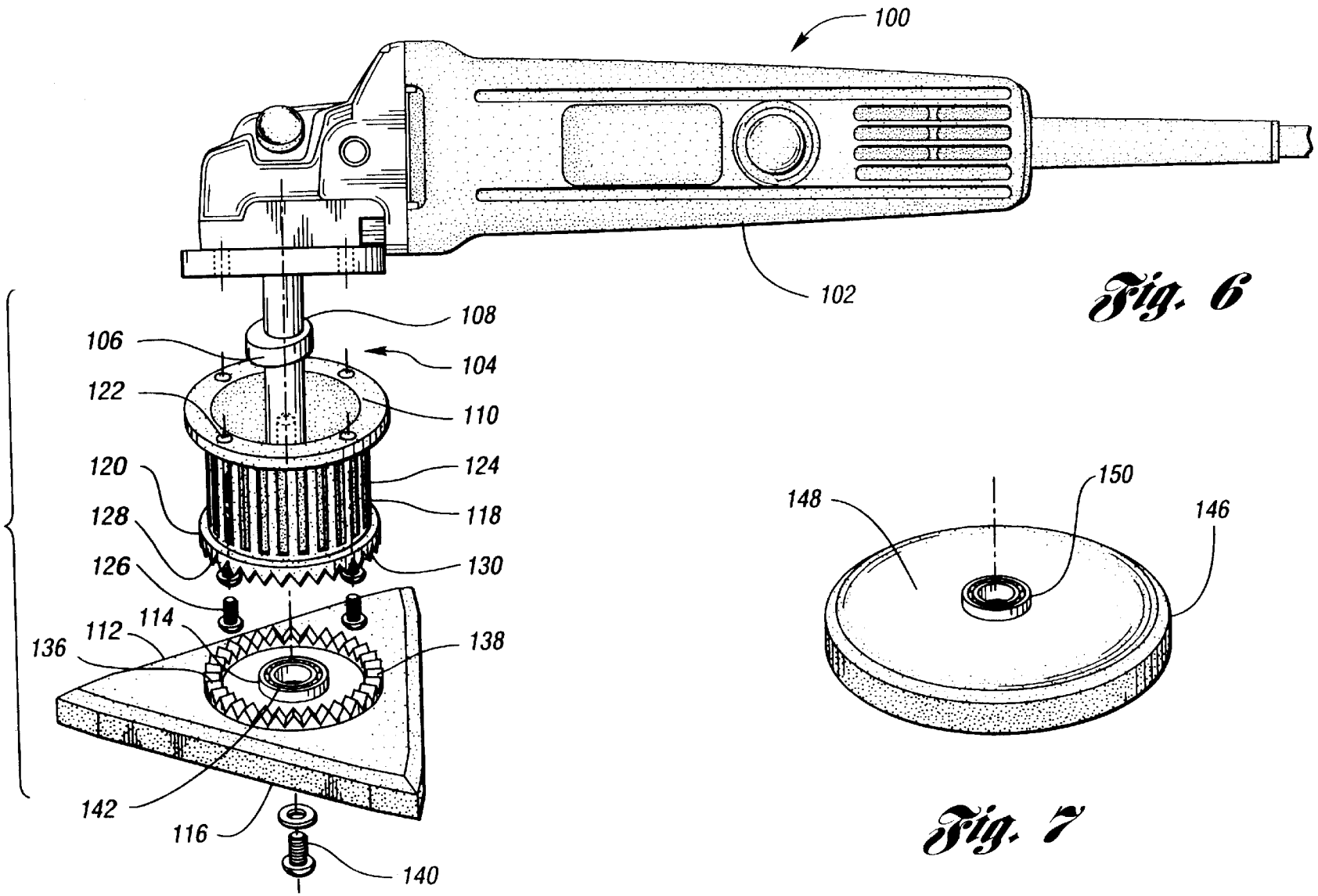
FIG. 6 is an exploded side view of another embodiment of the present invention, which allows the use of interchangeable working members with the orbital tool, and illustrates a first working member for use with the orbital tool.
FIG. 7 is a second working member for use with the orbital tool shown in FIG. 6.

Referring to FIG. 6, another embodiment of the present invention, which allows the use of interchangeable working members with the orbital tool, is illustrated. The orbital tool is illustrated as a detail sander 100 including a housing 102 and a motor (not specifically shown). A center pivot mechanism 104 has an eccentric drive member 106. An input portion 108 of eccentric drive member 106 is rotatably driven by the motor drive shaft. A working member 112 includes an input portion 114 for connection to output portion 110 of eccentric drive member 106. Working member 112 also includes a working surface 116 for engaging a workpiece (not shown).

An annular pivot control member 118 includes central hub 120 and flange 122. Flange 122 is attached to the housing 102 by screws 126. Web 124 extends circumferentially about the drive and eccentric axes between flange 122 and the central hub 120. Central hub 120 has a mating surface 128 with circumferentially spaced teeth 130 protruding from a face of the mating surface 128.

Another mating surface 136 is located on the central hub 120. Circumferentially spaced teeth 138 protrude from a face of the central hub mating surface 136. The central hub mating surface 136 and the working member mating surface 128 are configured with respect to each other to substantially prevent pivotal movement of the working member relative to the housing by face to face mating contact of the mating surfaces. Screw 140 secures the working member 112 to the output portion 110 of eccentric drive member 106. A bearing 142 allows the working member 112 to substantially retain its angular position while orbiting the drive axis.

It is to be appreciated that the circumferentially spaced teeth 130 and 138 located on mating surfaces 128 and 136, respectively, may alternatively be configured in other ways to substantially prevent pivotal movement of the working member 112 relative to the housing 102 during use of the detail sander 110. For example, the working member mating surface may be defined by a generally planer surface having two or more pin-like members protruding into recesses in the central hub mating surface.

Referring to FIG. 7, a second working member for use with the orbital tool shown in FIG. 6 is indicated at 146. The working member 146 preferably includes a smooth surface 148 positioned to mate with the central hub teeth 130 (FIG. 6). The smooth surface 148 has a sufficiently low coefficient of friction to allow pivotal movement of the working member 146 relative to the housing 102 (FIG. 6). The second working member may rotate about the eccentric axis on a bearing 150, while orbiting the drive axis.

In operation of the embodiment of the present invention shown in FIGS. 6 and 7, a user would select the appropriate working member for a given task. The first working member 112 (FIG. 6) has a mating surface configured to substantially prevent pivotal movement of the first working member 112 (FIG. 6) relative to the housing 102. That is, a constrained pivot sanding operation may be performed by selecting the first working member 112 (FIG. 6). The second working member 146 (FIG. 7) has a mating surface configured to allow pivotal movement of the working member. That is, a random pivot sanding operation may be performed by selecting the second working member 146 (FIG. 7).

Figure 8:
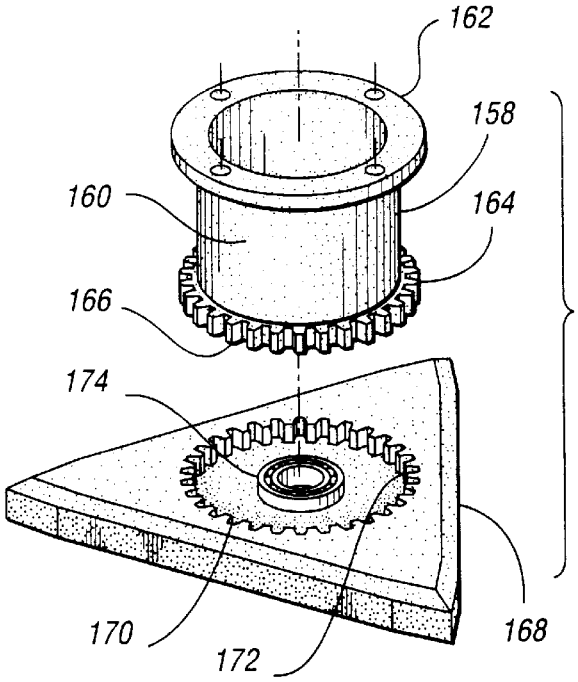
FIG. 8 is yet another embodiment of the present invention, which allows the use of interchangeable working members with the orbital tool, and illustrates a first working member for use with the orbital tool.
Figure 9:
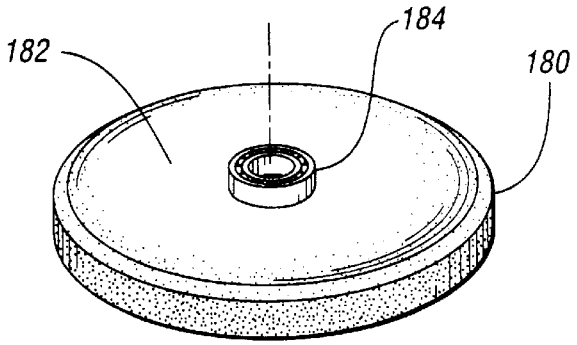
FIG. 9 is a second working member for use with the orbital tool shown in FIG. 8.
Figure 10:
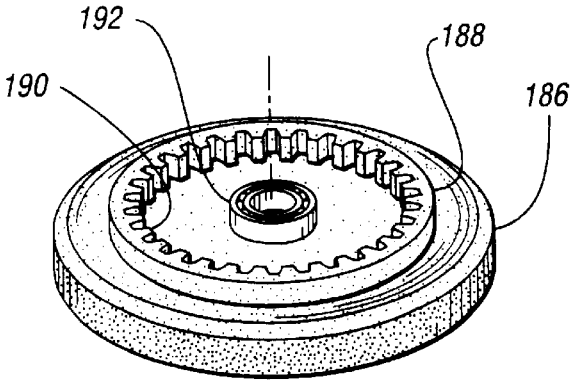
FIG. 10 is a third working member for use with the orbital tool shown in FIG. 8.

Referring to FIGS. 8–10, yet another embodiment of the present invention, which allows the use of interchangeable working members, will now be described. With particular reference to FIG. 8, an annular pivot control member 158 is preferably formed of an elastic material and includes annular flange 162 for attachment to the orbital tool housing, and central hub 164 for controlling pivotal movement of a working member. The central hub mating surface is defined by a gear having circumferentially spaced teeth 166 extending outwardly from the periphery of the central hub 164.

A plurality of interchangeable working members may be selectively used with pivot control member 158. A first working member 168 is shown in FIG. 8. The first working member 168 has a mating surface defined by a gear 170 with a plurality of circumferentially spaced teeth 172 extending inwardly from a periphery of the gear 170. The first working member 168 may be mounted to the eccentric drive shaft of the orbital tool at input portion 174.

When first working member 168 is mounted for use on an orbital tool, the working member gear 170 mates with central hub gear 164 by locking reception of the central hub gear 164 within the working member gear 170 to substantially prevent rotation of the first working member 168 relative to the housing. Web 160 elastically deforms sufficiently to enable the working member input portion 174 to orbit the drive axis, while constraining any pivotal movement of working member 168.

Referring to FIG. 9, a second working member 180 is shown. The second working member 180 may be used in conjunction with pivot control member 158 (FIG. 8) to provide a random pivoting or freely rotating working member. Preferably, a smooth surface 182 has a sufficiently low coefficient of friction to allow pivotal movement of the second working member 180 relative to the orbital tool housing, on bearing 184. Central hub 164 (FIG. 8) may act as a brake, as desired, to slow the rotation of the second working member 180.

Referring to FIG. 10, a third working member 186 is shown. The third working member 186 may be used in conjunction with pivot control member 158 (FIG. 8) to provide a controlled pivot or controlled rotation working member. The mating surface of third working member 186 is defined by a gear 188 having circumferentially spaced teeth 190 extending inwardly from a gear periphery. The circumference of working member gear 188 is larger than the circumference of central hub gear 164 (FIG. 8). During use of the third working member, the working member gear teeth 190 engage the central hub gear teeth 166 (FIG. 8). The gears have a cycloidal relationship with each other which provides controlled rotation of the third working member on bearing 192. The angular velocity of third working member 186 is based on the eccentric drive member speed and the gear ratio between the central hub gear 164 (FIG. 8) and the third working member gear 188.

Figure 11:
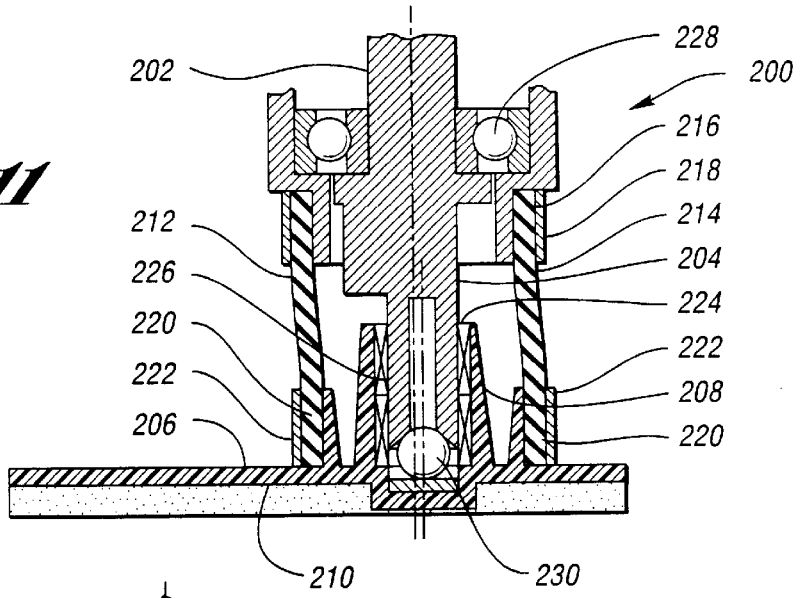
FIG. 11 illustrates an alternative center pivot mechanism for an orbital tool of the present invention.

With reference to FIG. 11, an alternative center pivot mechanism for an orbital tool of the present invention is generally indicated at 200. An eccentric drive member 202 has an output portion 204 for connecting to a working member 206, at a working member input portion 208. The working member 206 also has a working surface 210. An annular pivot control member 212 includes a web 214 extending from a flange 216 held by a first clamp 218, to a central hub 220 held by a second clamp 222. The input portion 208 of the working member 206 defines a cylindrical cavity 224. The output portion 204 of the eccentric drive member 202 defines a cylindrical shaft 226 received in the cylindrical cavity 224 of the working member input portion 208. Cylindrical cavity 224 has bearings 228 located about the cavity periphery. Preferably, a ball 230 is received in cavity 224 to abut the end of shaft 226.

It is to be appreciated that the alternative embodiment shown in FIG. 11 is somewhat similar to the orbital tool embodiment shown in FIGS. 1–5. Further, it is to be appreciated that there are a variety of ways to secure the working member of the orbital tool to the eccentric drive member, while utilizing an annular pivot control member cooperating with both the housing and the working member.

Figure 12:
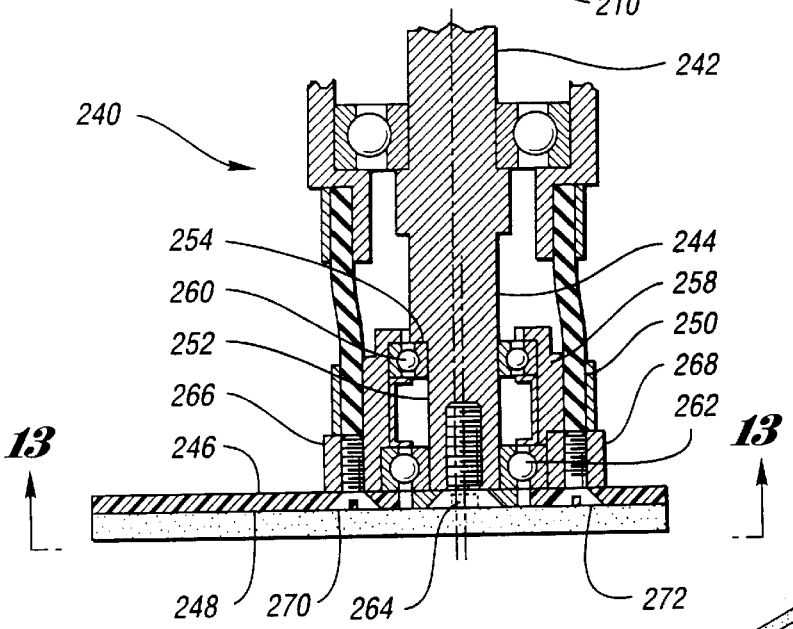
FIG. 12 illustrates another alternative center pivot mechanism for an orbital tool of the present invention.
Figure 13:
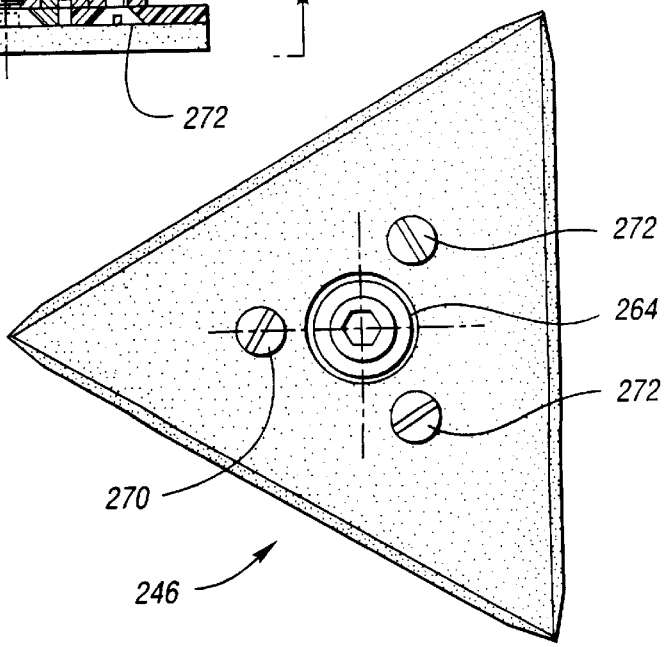
FIG. 13 is a cross-sectional view showing the working member of the orbital tool shown in FIG. 12, taken along line 13—13 of FIG. 12.

With reference to FIGS. 12 and 13, another alternative center pivot mechanism for an orbital tool of the present invention is generally indicated at 240. Center pivot mechanism 240 is somewhat similar to center pivot mechanism 200 (FIG. 11), and to center pivot mechanism 22 (FIGS. 1–5). Center pivot mechanism 240 includes an eccentric drive member 242 having an output portion 244. A working member 246 has a working surface 248. An annular pivot control member 250 encircles eccentric drive member 242. Output portion 244 of eccentric drive member 242 defines a shaft end portion 252. A shoulder 254 defined by shaft end portion 252 abuts carriage 258. Carriage 258 serves as the working member input portion, and houses first and second bearings 260 and 262, respectively, to allow pivoting of carriage 258 on shaft end portion 252. A screw 264 secures the carriage 258 on the shaft end portion 252. Holes 266 and 268 in the bottom of carriage 258 receive screws 270 and 272, respectively, to secure the working member 246 to the carriage 258.

Figure 14:
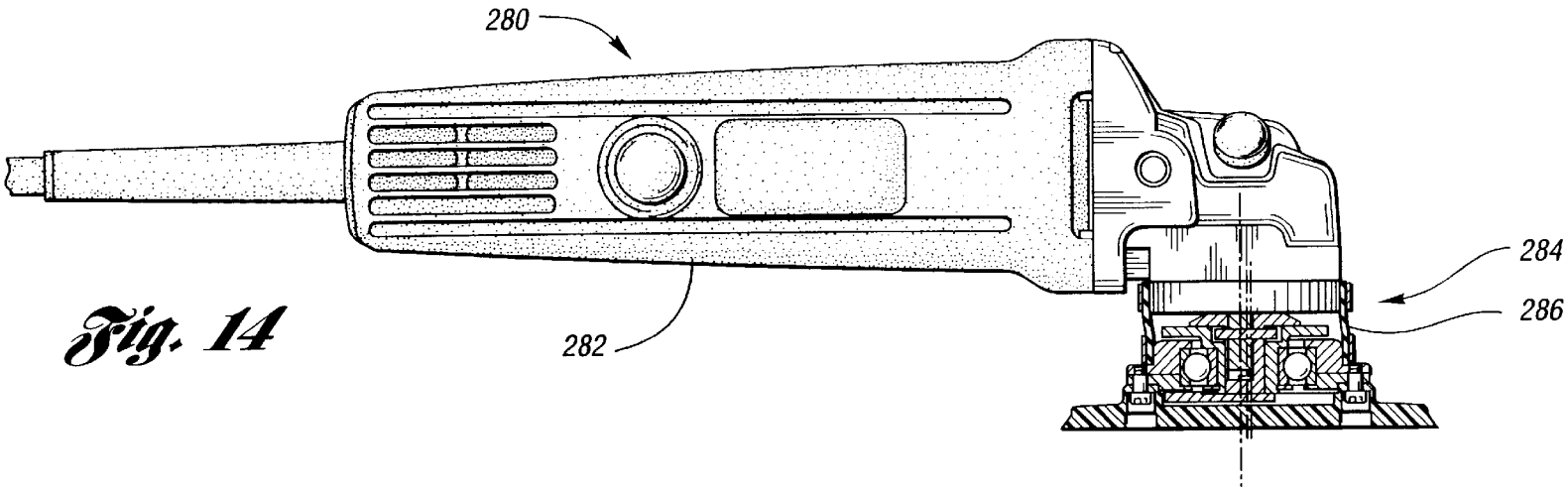
FIG. 14 is a side view of a further embodiment of the present invention, illustrating an orbital tool having an adjustable eccentricity center pivot mechanism encircled by an annular pivot control member.
Figure 15:
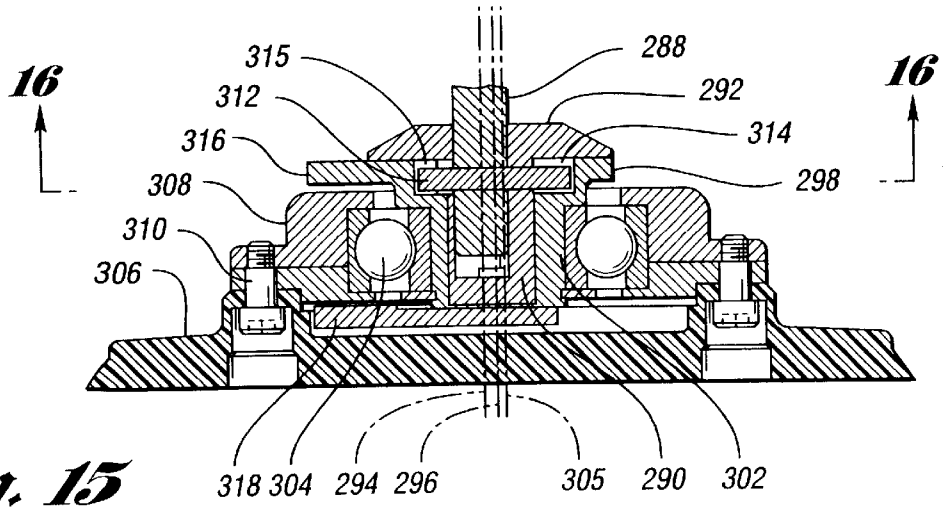
FIG. 15 is an enlarged cross-sectional view of the center pivot mechanism of the orbital tool shown in FIG. 14.

With reference to FIGS. 14 and 15, an orbital tool of the present invention having an adjustable eccentricity center pivot mechanism will be described. Detail sander 280 has a housing 282 and a center pivot mechanism 284 encircled by an annular pivot control member 286. As best shown in FIG. 15, an eccentric drive member 288 is pivotally supported relative to the housing and rotatably driven by the motor shaft. The eccentric drive member 288 has an output portion 290 which defines a seat 292. The eccentric drive member is driven about a drive axis 294; and, the eccentric drive member output portion 290 defines an eccentric axis 296 generally parallel to and radially offset from the drive axis 294.

An intermediate drive member 298 is pivotally supported relative to the eccentric drive member, in part by a bearing 300. An output portion 302 of intermediate drive member 298 is aligned along a working axis 305 generally parallel to and radially offset from the eccentric axis 296. A working offset is defined as the distance between the working axis 305 and the drive axis 294. The intermediate drive member 298 is selectively rotatable through different positions about the eccentric drive member 288 to vary the working offset, as will be further described.

Figure 16:
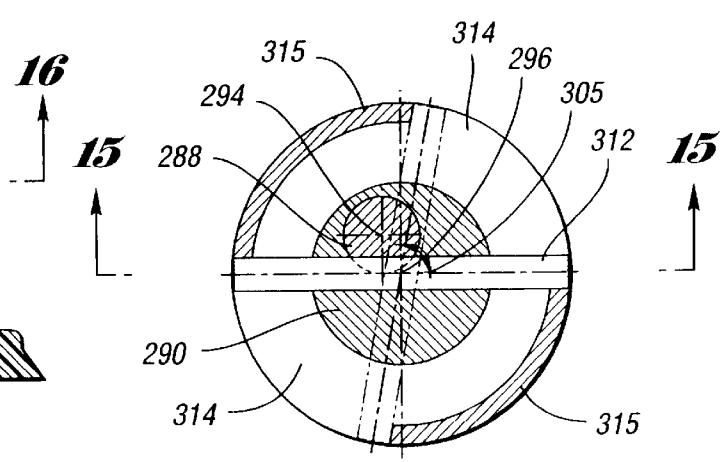
FIG. 16 is a cross-sectional view taken along line 16—16 of FIG. 15 to illustrate a pin and slot arrangement that allows the working offset to be changed by reversing motor rotational direction.

A working member 306 has an input portion 308 aligned along the working axis 305 pivotally engaging the output portion 302 of the intermediate drive member 298. The working member input portion 308 encircles the outer race of bearing 304, and receives screws 310 to secure working member 306 thereto. As best shown in FIGS. 15 and 16, in the embodiment illustrated, a pin 312 extends through eccentric drive member output portion 290. A corresponding plurality of arcuate slots 314 are located on intermediate drive member 298. The slots are sized to allow the intermediate drive member 298 to be rotated relative to the eccentric drive member 288 over a finite angle between a first position defining a first working offset, and a second position defining a second working offset which is different than the first working offset. Rotation of intermediate drive member 298 is restricted by stops 315 (FIG. 16) Because working axis 305 rotates relative to eccentric axis 296 as intermediate drive member 298 rotates relative to eccentric drive member 288, while eccentric axis 296 remains fixed relative to drive axis 294, the working offset is varied. In the embodiment illustrated, the intermediate drive member 298 is selectively rotated by reversing motor rotational direction to allow the pin 312 to slide between the ends of the arcuate slots 314, and abut stops 315. However, it is to be appreciated that other structures may be substituted for the slot and pin arrangement shown.

As shown in FIG. 15, a first balance 316 mass is positioned to rotate together with intermediate drive member 298. A second balance mass 318 is positioned to rotate together with eccentric drive member 288.

Figure 17:
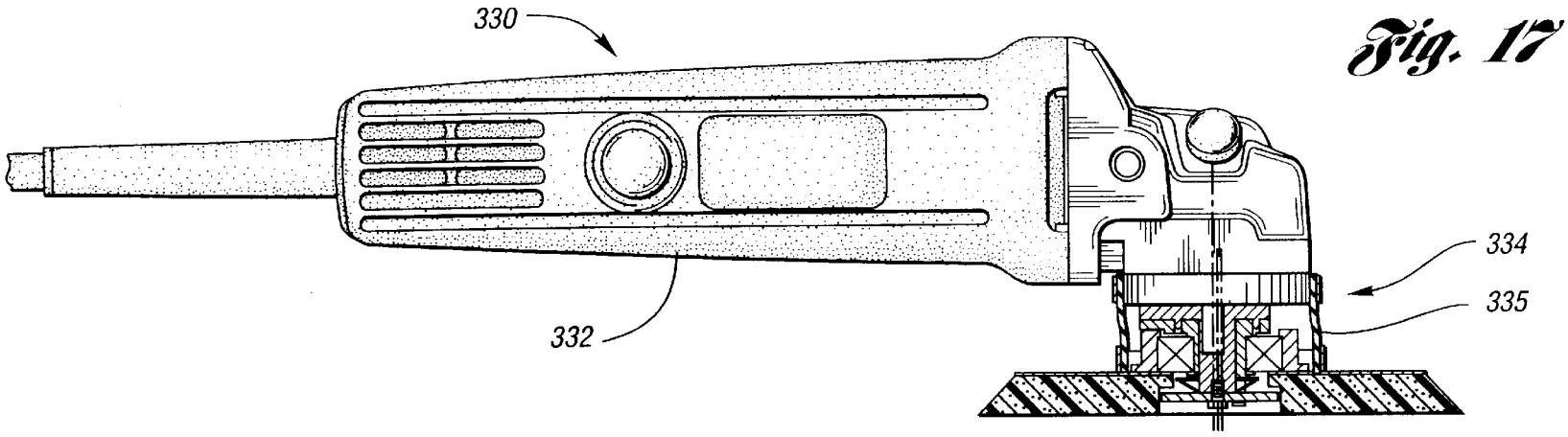
FIG. 17 is a side view of an even further embodiment of the present invention, illustrating an orbital tool having an adjustable eccentricity center pivot mechanism encircled by an annular pivot control member.
Figure 18:
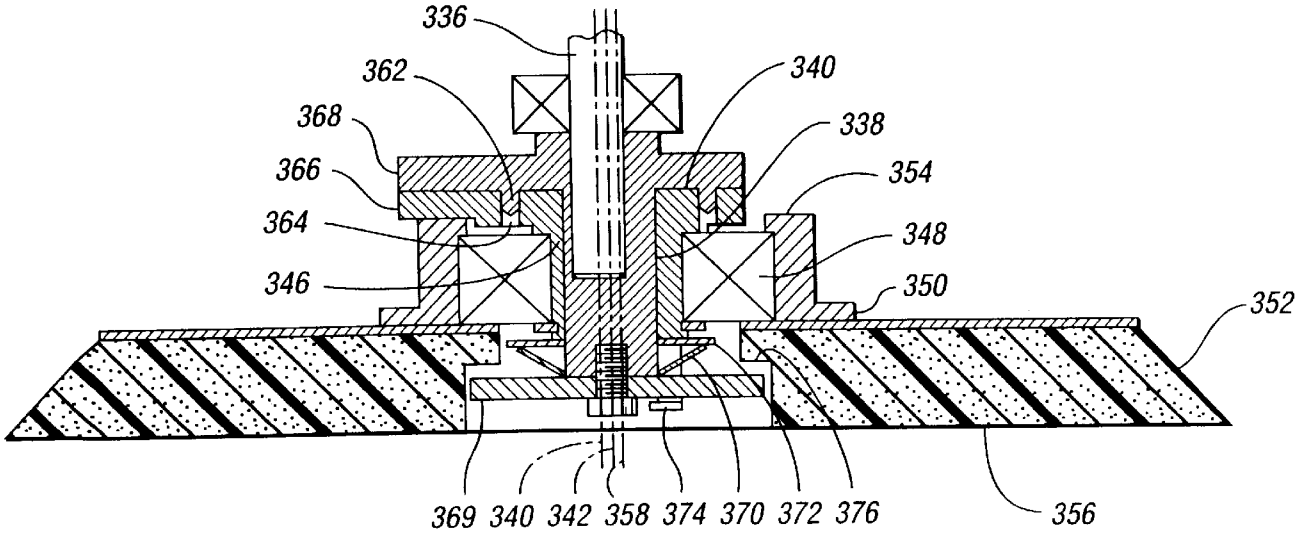
FIG. 18 is an enlarged cross-sectional view of the center pivot mechanism of the orbital tool shown in FIG. 17.

With reference to FIG. 17, an even further embodiment of the present invention is illustrated. An orbital tool having an adjustable eccentricity center pivot mechanism encircled by an annular pivot control member is generally indicated at 330. The orbital tool 330 has a housing 332, and a center pivot mechanism 334. Center pivot mechanism 334 is shielded by annular pivot control member 335 in accordance with the present invention. As best shown in FIG. 18, orbital tool 330 has an eccentric drive member 336 with an output portion 338. The output portion 338 defines a seat 340, and rotates about a drive axis 342. The output portion 338 of eccentric drive member 336 defines an eccentric axis 344 generally parallel to and radially spaced from the drive axis 342. An intermediate drive member 346 is pivotally supported relative to the eccentric drive member. A bearing 348 encircles an intermediate drive member output portion 350. A working member 352 has an input portion 354 which engages the outside of bearing 348. The working member 352 also has a working surface 356. Bearing 348 allows working member 352 to pivot about a working axis 358 generally parallel to and radially offset from the eccentric axis 344.

A working offset is defined between the working axis 358 and the drive axis 342, as described previously. The intermediate drive member 346 is selectably rotatable relative to the eccentric drive member 336 through a variety of different angular positions at which the intermediate drive member 346 may be fixed relative to the eccentric drive member 336 to allow a variety of different working offsets. A plurality of pins 362, such as a pair of pins, cooperate with a plurality of holes 364, such as multiple pairs of holes to selectively fix intermediate drive member 346 relative to eccentric drive member 336.

With continuing reference to FIG. 18, a first balance mass 366 is positioned to rotate together with the intermediate drive member 346. A second balance mass 368 is positioned to rotate together with the eccentric drive member 336. A spring, such as a Belleville spring 70, engages a spring seat 372 with one of its axial ends, and engages an enlarged spring seat 369 with its other axial end. By a user pushing on the end of eccentric drive member 336 (or pulling working member 352), enlarged spring seat 369 is urged away from stop 374 and toward shoulder 376. By axially moving the eccentric drive member 336 relative to the intermediate drive member 346, pins 362 may be lifted out of holes 364 to allow for rotation of the eccentric drive member 336 with respect to the intermediate drive member 346 to vary the eccentricity of the center pivot mechanism 334. Alternatively, mating square teeth may be provided instead of the pins and holes to allow numerous different eccentricity settings.

It is to be appreciated that embodiments of the present invention provide center pivot mechanisms having pivot control members for a variety of orbital tool operations, such as constrained pivoting, controlled pivoting, and free pivoting of the working member. Further, embodiments of the present invention may be employed in orbital tools having multiple eccentricity mechanisms, such as those in which eccentricity is determined by motor rotational direction, and others.

With reference to FIG. 19, a diagram illustrates first and second balance masses selected and positioned in accordance with the present invention. The drive axis is indicated at 380; and, the eccentric axis is indicated at 382. The eccentric axis 382 rotates about the drive axis along circle 384 as the drive shaft is rotated. The working axis is selectively rotatable about circle 386, with the intermediate drive member, as the intermediate drive member is selectively rotated about the eccentric axis 382. To facilitate an understanding of the present invention, only two positions of the working member are illustrated. However, it is to be appreciated that embodiments of the present invention provide balanced operation for the working member at all positions on circle 386.

A working member in an exemplary first position is shown at 388; the working member in an exemplary second position is shown at 390. A first balance mass is positioned to rotate together with the intermediate drive member and working member about the eccentric axis 382. The first balance mass in a first position corresponding to the first position 388 of the working member is indicated at 394. The first balance mass in a second position corresponding to the second position 390 of the working member is indicated at 396. The first balance mass is selected and positioned to balance the working member about the eccentric axis. That is, the first balance mass is selected based in part on a first distance defined between the eccentric axis 382 and the working axis (on circle 386) to substantially minimize the moments of mass about the eccentric axis due to the working member.

For example, for a working member mass M of 100 grams and a distance r between the eccentric and working axes of 1.5 millimeters, a first balance mass $m_1$ of about 7.5 grams may be selected and positioned about 20 millimeters from the eccentric axis directly opposite (180 degrees from) the working member to substantially minimize the moments of mass about the eccentric axis due to the working member (and the first balance mass). of course, the desired mass and/or position of the first balance mass may vary based on other masses which rotate together with the intermediate member about the eccentric axis. Further, it is to be appreciated that the mass and position are inversely proportional to each other and that the mass is selected and positioned such that the moments of mass about the eccentric axis are each about zero. The values given above are merely exemplary. Preferably, the first balance mass is positioned close enough to the eccentric axis so that an annular pivot control member may encircle the drive, eccentric, and working axes, while encircling the first balance mass as well.

A second balance mass is positioned to rotate together with the eccentric drive member about the drive axis 380. The second balance mass is indicated at 398 and rotates along circle 400. The second balance mass is selected and positioned to balance the working member and first balance mass about the drive axis. That is, the second balance mass is selected based in part on a second distance defined between the drive axis 380 and the eccentric axis 382 to substantially minimize the moments of mass about the drive axis due to the first balance mass and working member.

For example, for a working member mass M of 100 grams, a first balance mass $m_1$ of 7.5 grams, and a second distance d defined between the eccentric and drive axes of 3.0 millimeters, a second balance mass $m_2$ of about 16.1 grams may be selected and positioned about 20 millimeters from the drive axis directly opposite (180 degrees from) the eccentric axis to substantially minimize the moments of mass about the drive axis due to the working member and first balance mass (and second balance mass). Of course, the desired mass and/or position of the second balance mass may vary based on other masses which rotate together with the eccentric drive member about the drive axis. Further, it is to be appreciated that the mass and position are inversely proportional to each other and that the mass is selected and positioned such that the moments of mass about the drive axis are each about zero. The values given above are merely exemplary. Preferably, the second balance mass is positioned close enough to the drive axis so that an annular pivot control member may encircle the drive, eccentric, and working axes, while encircling the second balance mass as well.

In the exemplary embodiment described above, with a first distance r between the eccentric and working axes of 1.5 millimeters, and a second distance d between the drive and eccentric axes of 3.0 millimeters, the first distance is advantageously less than the second distance. In addition to balanced operation at all selectable eccentricities, the lesser first distance reduces the moment of inertia about the eccentric axis due to the first balance mass and the working member. The reduced moment of inertia makes embodiments of the present invention practical by reducing component loading and wear. Particularly, when the motor rotational direction determines the working member offset or eccentricity, the reduced moment of inertia reduces loading at impact of the pin with the stops in the embodiment shown in FIGS. 14–16. Further, the first distance r being less than the second distance d allows more versatility for different eccentricities while facilitating construction of the tool.

With reference to FIG. 20, a graph depicts working offset in millimeters versus intermediate drive member angular position in degrees, in an exemplary embodiment of the present invention having a first distance between the eccentric and working axes of about 1.5 millimeters, and a second distance between the drive and eccentric axes of about 3.0 millimeters. The working offset as a function of angle is generally indicated at 410. In an embodiment in which the intermediate drive is selectively rotated over a finite angle by reversing motor rotational direction, the finite angle is preferably less than 180 degrees. Further, the finite angle is preferably not more than 90 degrees with the second working offset being about twice the value of the first working offset. In the exemplary embodiment depicted in FIGS. 19 and 20, the finite angle is about 85 degrees and is indicated at $\Delta\theta$ (FIG. 19), with the first working offset of about 2.0 millimeters indicated at point 412 (FIG. 20), and the second working offset of about 4.0 millimeters indicated at point 414 (FIG. 20).

It is to be appreciated that the working offset function R may be described by the following equation:

$$R = \sqrt{d^2 - 2dr\cos(\theta) + r^2}$$

wherein r is the first distance defined between the and working axes, d is the second distance defined between the drive and eccentric axes, and $\theta$ is the angular position of the working axis with respect to the eccentric axis.

While the best mode for carrying out the invention has been described in detail, those familiar with the art to which this invention relates will recognize various alternative designs and embodiments for practicing the invention as defined by the following claims.

What is claimed is:

1. An orbital tool comprising:

a housing;

a motor oriented within the housing and having a rotatable motor shaft;

an eccentric drive member pivotally supported relative to the housing and rotatably driven by the motor shaft about a drive axis, the eccentric drive member having an output portion aligned along an eccentric axis generally parallel to and radially offset from the drive axis;

a working member having an input portion coaxially aligned along the eccentric axis of the output member and pivotally engaging the output portion of the eccentric drive member, a mating surface, and a working surface perpendicular to the drive axis and extending radially outboard of the working member input portion; and an annular pivot control member including an annular central hub having a mating surface, an annular flange engaging the housing at a location spaced from the central hub, and a web extending circumferentially about the drive and eccentric axes between the flange and the central hub, the central hub mating surface cooperating with the working member mating surface to control pivotal movement of the working member relative to the housing while the web enables the working member input portion to orbit about the drive axis as the eccentric drive member is rotated by the motor shaft.

2. The orbital tool of claim 1 wherein the pivot control member is generally cylindrical and aligned parallel to the drive axis, and wherein one axial end of the pivot control member forms the flange and another axial end of the pivot control member forms the central hub.

3. The orbital tool of claim 1 wherein the web of the pivot control member is formed of an elastic material, and wherein the flange is affixed to the housing, and the central hub mating surface is affixed to the working member mating surface such that the web prevents the working member from freely rotating relative to the housing while elastically deforming sufficiently to enable the working member input portion to orbit the drive axis as the eccentric drive member is rotated by the motor shaft.

4. The orbital tool of claim 3 wherein the output portion of the eccentric drive member defines a cylindrical cavity and the input portion of the working member defines a cylindrical shaft received in the cylindrical cavity of the eccentric drive member output portion.

5. The orbital tool of claim 3 wherein the input portion of the working member defines a cylindrical cavity and the output portion of the eccentric drive member defines a cylindrical shaft received in the cylindrical cavity of the working member input portion.

6. The orbital tool of claim 1 wherein the working member input portion is attached to the eccentric drive member output portion, and wherein the flange is affixed to the housing, and the central hub mating surface and the working member mating surface engage each other and are configured with respect to each other to substantially prevent pivotal movement of the working member relative to the housing as the eccentric drive member is rotated by the motor shaft.

7. The orbital tool of claim 6 wherein the central hub mating surface includes circumferentially spaced teeth, and the working member mating surface includes circumferentially spaced teeth configured to mate with the central hub teeth.

8. The orbital tool of claim 1 wherein the working member input portion is attached to the eccentric drive member output portion, and wherein the flange is affixed to the housing, and the central hub mating surface and the working member mating surface are configured with respect to each other to allow pivotal movement of the working member relative to the housing as the eccentric drive member is rotated by the motor shaft.

9. The orbital tool of claim 1 wherein the working member input portion is attached to the eccentric drive member output portion, and wherein the flange is affixed to the housing, and the central hub mating surface is defined by a gear having circumferentially spaced teeth, and the working member mating surface is defined by a gear having circumferentially spaced teeth about a larger circumference than a central hub gear circumference, with the central hub gear teeth engaging the working member gear teeth to provide controlled rotation of the working member relative to the housing as the eccentric drive member is rotated by the motor shaft.

10. The orbital tool of claim 1 wherein the web of the pivot control member is formed of an elastic material.

11. The orbital tool of claim 1 wherein the web of the pivot control member is one continuous piece which substantially shields the output portion of the eccentric drive member and the working member input portion.

12. An orbital tool comprising:

a housing;

a motor oriented within the housing and having a rotatable motor shaft;

an eccentric drive member pivotally supported relative to the housing and rotatably driven by the motor shaft about a drive axis, the eccentric drive member having an output portion aligned along an eccentric axis generally parallel to and radially offset from the drive axis;

a working member having an input portion coaxially aligned along the eccentric axis of the output member and pivotally engaging the output portion of the eccentric drive member, and a working surface perpendicular to the drive axis and extending radially outboard of the working member input portion; and an annular pivot control member including an annular central hub affixed to the working member about the working member input portion, an annular flange attached to the housing at a location spaced from the central hub, and an elastic web extending circumferentially about the drive and eccentric axes between the flange and the central hub, the elastic web preventing the working member from freely rotating relative to the housing while elastically deforming sufficiently to enable the working member input portion to orbit about the drive axis as the eccentric drive member is rotated by the motor shaft.

13. An orbital tool of claim 12 wherein the working member is selected from a plurality of working members comprising:

a first working member having a working member mating surface including circumferentially spaced teeth configured to mate with the central hub teeth to substantially prevent pivotal movement of the first working member relative to the housing, when the first working member is selected; and a second working member having a working member mating surface including a smooth surface positioned to mate with the central hub teeth and having a sufficiently low coefficient of friction to allow pivotal movement of the second working member relative to the housing, when the second working member is selected.

14. The orbital tool of claim 13 wherein the central hub teeth protrude from a face of the central hub mating surface, and the first working member teeth protrude from a face of the first working member mating surface such that the central hub mates with the first working member by face to face contacting of the central hub mating surface and the first working member mating surface, when the first working member is selected.

15. The orbital tool of claim 13 wherein the central hub teeth extend outwardly from a periphery of a central hub gear, and the first working member teeth extend inwardly from a periphery of a first working member gear such that the central hub mates with the first working member by locking reception of the central hub gear within the first working member gear, when the first working member is selected.

16. The orbital tool of claim 15 wherein the plurality of working members further comprises:

a third working member having a working member mating surface defined by a gear having circumferentially spaced teeth extending inwardly from a gear periphery and spaced about a larger circumference than a central hub gear circumference, the central hub gear teeth engaging the third working member gear teeth to provide controlled rotation of the third working member relative to the housing as the eccentric drive member is rotated by the motor shaft, when the third working member is selected.

* * * * *